United States Patent [19]

Sando et al.

[11] 4,121,441

[45] Oct. 24, 1978

[54] SEALING DEVICE IN A HIGH PRESSURE STEAMER

[75] Inventors: Yoshikazu Sando; Hiroshi Ishidoshiro, both of Wakayama, Japan

[73] Assignee: Sando Iron Works, Co., Ltd, Japan

[21] Appl. No.: 857,987

[22] Filed: Dec. 6, 1977

Related U.S. Application Data

[63] Continuation of Ser. No. 703,587, Jul. 8, 1976, abandoned.

[30] Foreign Application Priority Data

Jul. 28, 1975 [JP] Japan ..... 50-91802

[51] Int. Cl.[2] ..... D06B 23/18

[52] U.S. Cl. ..... 68/5 E; 34/242

[58] Field of Search ..... 68/5 E; 34/242

[56] References Cited

U.S. PATENT DOCUMENTS

| | | | |
|---|---|---|---|
| 2,873,597 | 2/1959 | Fahringer | 68/5 E |
| 3,174,230 | 3/1965 | Green et al. | 34/242 X |
| 3,546,902 | 12/1970 | Sando et al. | 68/5 E |
| 3,768,281 | 10/1973 | Sando et al. | 68/5 E |

*Primary Examiner*—Philip R. Coe

*Attorney, Agent, or Firm*—Toren, McGeady and Stanger

[57] ABSTRACT

A sealing device in a high pressure steamer which includes a pressure reducing chamber disposed between a cloth material inlet port of a drum body of the steamer and rubber seal rolls. The sealing device further includes a high pressure air supply pipe connected to the pressure reducing chamber; heat resistant seal rolls disposed beneath the pressure reducing chamber at a cloth passing port provided in the pressure reducing chamber on the side of the drum body of the steamer, the heat resistant seal rolls being provided for the purpose of making the pressure reducing chamber into a high pressure air chamber preventing the steam inside the steamer drum body from coming into the chamber; and a water reservoir which is formed with the frame thereof disposed close to each of the rubber seal rolls to cover about ¼ of the circumference of the rubber seal roll. The surfaces of the rubber seal rolls are constantly washed clean by the water contained in the water reservoir and by other cleaning means.

1 Claim, 2 Drawing Figures

SEALING DEVICE IN A HIGH PRESSURE STEAMER

This is a continuation of application Ser. No. 703,587 filed on July 9, 1976, and now abandoned.

BACKGROUND OF THE INVENTION

This invention relates to a sealing device for a high pressure steamer which is used for processing textile products under a high pressure and more particularly to a sealing device to be disposed at the textile product inlet or outlet port of the high pressure steamer.

The present inventors have conducted research for a high pressure steamer to be used for processing a cloth material at a high temperature and under high pressure and also for sealing devices that permit guiding a cloth material into or out of such high pressure steamers, while maintaining the high temperature and high pressure inside the steamer. As a result of such research, the inventors have hitherto filed many patent applications for such high pressure steamers and such sealing devices. One of such previous patent applications is a sealing device, wherein a sealing effect is ensured by the provision of a pressure reducing chamber between the cloth material inlet or outlet port of a steamer drum body and a roll sealing arrangement comprising a combination of rubber seal rolls and metal seal rolls. In such a sealing arrangement, however, the steam inside the steamer comes into the pressure reducing chamber. The heat of the steam, then, causes the surface temperature of the rubber rolls employed in the roll seal arrangement to increase to such an extent that the rubber seal rolls tend to deteriorate and come to readily allow dyes to stick to their surfaces or they come to swell in the middle. The sealing effect has been lowered by such deterioration and that has presented a problem with such a sealing device.

SUMMARY OF THE INVENTION

It is therefore the principal object of this invention to provide a sealing device which is free from such a shortcoming of the previous sealing device.

In accordance with this invention, a high pressure air supply pipe is connected to a pressure reducing chamber which is provided between the cloth inlet port of a steamer drum body and rubber seal rolls of the sealing device. Furthermore, there are provided heat resistant seal rolls beneath the pressure reducing chamber at a cloth passing port provided in the pressure reducing chamber on the side of the drum body for the purpose of preventing the steam inside the steamer drum body from coming into the pressure reducing chamber. The pressure reducing chamber is thus made to serve as a high pressure air chamber. On the other hand, a water reservoir is formed with the frame thereof disposed close to each of the rubber seal rolls to cover about ¼ of the circumference of the rubber seal roll in such a manner that the surfaces of the rubber seal rolls are constantly washed clean by the water contained in the water reservoir and also by other cleaning means. This washing arrangement also serves the purpose of preventing the rubber seal rolls from being heated by the heat transferred thereto.

Thus, the high pressure air chamber which replaces the conventional pressure reducing chamber is supplied only with high pressure air so that the rubber seal rolls can be prevented from being heated and that the effect of sealing the drum body of the high pressure steamer also can be enhanced by the high pressure air supplied into the high pressure air chamber. In addition to such advantages, with the water reservoir provided for constantly washing the surfaces of the rubber seal rolls clean, the surfaces of the non heated rubber seal rolls are effectively maintained clean.

Other and further objects, features and advantages of this invention will appear more fully from the following detailed description of a preferred embodiment of the invention taken in connection with the accompanying drawings.

BRIEF DESCRIPTION OF THE DRAWINGS

The accompanying drawings illustrate an embodiment of the sealing device of this invention.

DETAILED DESCRIPTION OF THE INVENTION

Figure 1:
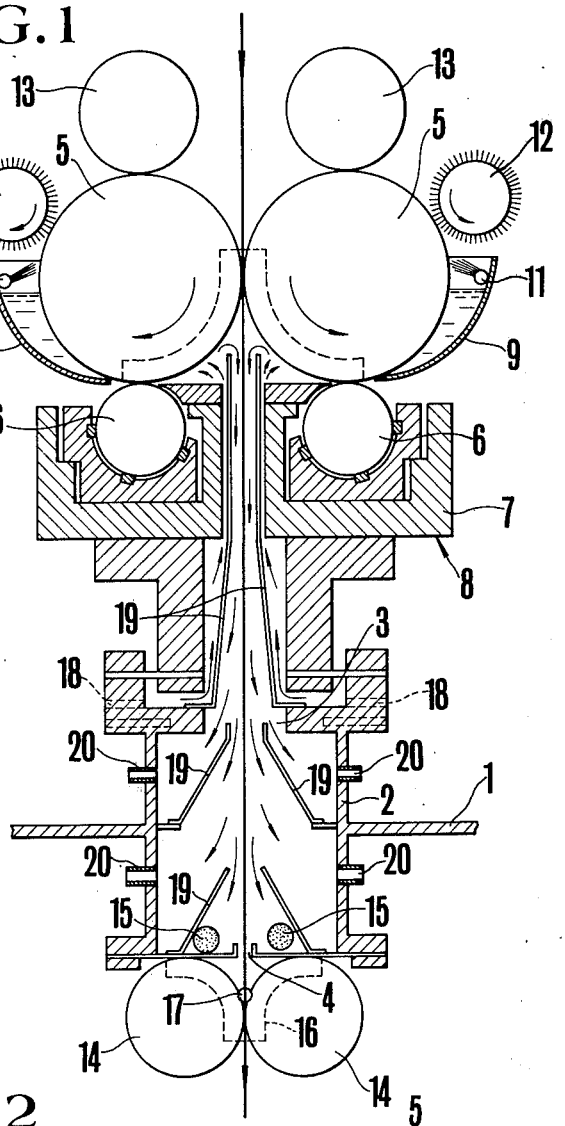
FIG. 1 is a sectional view of the embodiment.
Figure 2:
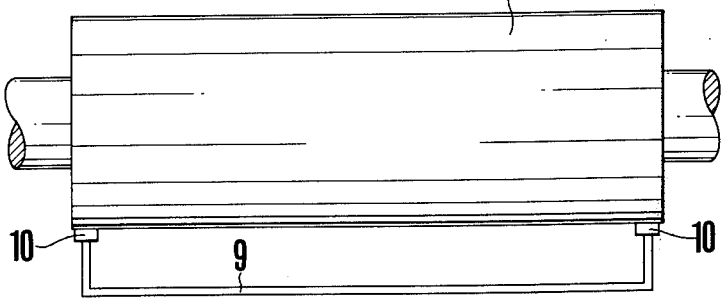
FIG. 2 a plan view illustrating the relation of the rubber seal rolls to the frame of the water reservoir.

A high pressure air chamber 2 is formed at a cloth guiding port to be provided in the drum body 1 of a high pressure steamer. In the upper and lower sides of the high pressure air chamber 2, there are provided cloth material passing ports 3 and 4 respectively. Above the upper cloth passing port 3, there is provided a roll seal arrangement 8 comprising a pair of rubber seal rolls 5, metal rolls 6 which are disposed in contact with the rubber seal rolls and a frame 7 which carries each of these rolls. The cloth passing port 3 is closed by the pair of rubber seal rolls 5. A water reservoir is formed by the combination of the rubber seal rolls and a water reservoir frame 9 which is disposed close to the rubber seal rolls in such a manner as to cover about ¼ of the circumference of each of the rubber seal rolls. As shown in FIG. 2, seal members 10 are inserted in between the water reservoir frame 9 and the rubber seal rolls 5. Shower pipes 11 are provided for the purpose of supplying water into the water reservoir as well as for showering water on the rubber seal rolls 5. Reference numerals 12 and 13 respectively indicate washing brush rolls and water removing rolls which are disposed in contact with the rubber seal rolls 5. A pair of heat resistant rolls 14 are disposed beneath the high pressure air chamber 2 in the close vicinity of the lower cloth passing port 4 to close the lower cloth passing port 4. The heat resistant seal rolls are made of a material that can resist a high temperature such as Teflon or the like. Inside the high pressure air chamber 2, there are provided drain members 15 on the bottom of the chamber 2. In this particular embodiment, the drain members 15 are made in the form of bundles of glass fibers to utilize capillarity for the combined purposes of draining and air venting. As for the drain between the seal rolls 14 on both sides of the cloth passing port 4, there are provided air vent holes 17 in end face seal plates 16 for the purpose of pushing out the drain together with the air vented. The reference numeral 18 indicates a high pressure air supply port; 19 air guide plates which allow the air supplied through the high pressure air supply port to flow downward from the upper part of the chamber 3; and 20 air release ports.

Since, in this embodiment, the lower cloth passing port 4 of the high pressure chamber 2 provided between the steamer drum body and the roll seal arrangement is closed by means of a pair of heat resistant seal rolls 14, the high temperature of the inside of the steamer drum body is not allowed to enter the high pressure air chamber 2, so that the rubber seal rolls can be prevented from being heated. Furthermore, with high pressure air supplied into the high pressure air chamber, the pressure inside the steamer drum body is prevented from escaping, so that the inside of the steamer drum body can be kept at a given constant pressure. In accordance with this invention, the water inside the water reservoir is arranged to be constantly in contact with a part of the outer circumferential face of each of the rubber seal rolls; and, in addition to that, the shower pipes shower water on the surfaces of the rubber seal rolls 5. Therefore, the rolls are always thoroughly washed clean as they rotate.

As clearly understood from the foregoing description, the rubber seal rolls not only can be prevented from being heated but also can be effectively washed clean. Thus, in accordance with this invention, not only the sealing effect on the high pressure steamer can be enhanced but also the service life of the rubber seal rolls is made longer to ensure the enhanced sealing effect over a long period of time besides the other features and advantages described in the foregoing.

What is claimed is:

1. A pressure sealing device for a high pressure steamer including a drum body, said device arranged to convey a cloth material between the interior of the drum body and the exterior of the high pressure steamer and comprising walls forming a pressure reducing chamber arranged to be mounted on and extend outwardly from the drum body and forming an axially extending cloth material passageway extending from the drum body to the exterior of the pressure steamer, said chamber having a first opening at one end of the passageway therethrough and arranged to pass the cloth material between the passageway and the drum body and a second opening at the opposite end of the passageway therethrough spaced from the first opening and arranged to open from the cloth material passageway to the exterior of the pressure steamer for passing the cloth material between the passageway and the exterior of the pressure steamer, a high pressure air supply pipe connected to said pressure reducing chamber for supplying high pressure air therein and said pipe located intermediate the opposite ends of the passageway through said chamber, a pair of heat resistant seal rolls arranged to be located exteriorly of said pressure reducing chamber in the drum body at the first opening for preventing steam from the drum body from entering through said first opening into the passageway, a pair of rubber seal rolls located exteriorly of said pressure reducing chamber at the second opening therefrom, a frame mounted on said pressure chamber adjacent the second opening therefrom and located between said pressure chamber and said rubber seal rolls, a pair of metal rolls mounted in said frame each on an opposite side of said passageway and each of said metal rolls disposed in contact with a different one of said rubber rolls, a water reservoir located outwardly from said frame and exteriorly of said pressure reducing chamber, said water reservoir spaced from said metal rolls and enclosing about ¼ of the circumferential periphery of said rubber rolls so that the surfaces of said rubber rolls can be washed clean by water contained in said water reservoir while maintaining said water reservoir clear of said metal rolls, and other cleaning means arranged to clean the circumferential peripheral surfaces of said rubber rolls at a location spaced angularly thereabouts from said water reservoir, air guide means located within the cloth material passageway and dividing the passageway into separate flow conduits extending in the direction between the first and second opening, one of the flow conduits laterally enclosing the cloth material passing through the cloth material passageway and the other flow conduit laterally enclosing the one of the flow conduits, said high pressure air supply pipe supplying air into the other flow conduit at a position spaced from the first opening and said other flow conduit arranged to direct the air toward the second opening for contact with said rubber seal rolls where the air reverses direction entering said one of the flow conduits for flow therethrough toward the first opening, air release ports located in said chamber between said high pressure air supply pipe and the first opening for conveying the high pressure air out of the passageway.

* * * * *